US006331102B1

(12) United States Patent
Takeuchi et al.

(10) Patent No.: US 6,331,102 B1
(45) Date of Patent: Dec. 18, 2001

(54) SCROLL TYPE FLUID MACHINERY

(75) Inventors: Makoto Takeuchi; Kou Tanaka, both of Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/600,865

(22) PCT Filed: Dec. 8, 1999

(86) PCT No.: PCT/JP99/06879

§ 371 Date: Aug. 9, 2000

§ 102(e) Date: Aug. 9, 2000

(87) PCT Pub. No.: WO00/34660

PCT Pub. Date: Jun. 15, 2000

(30) Foreign Application Priority Data

Dec. 9, 1998 (JP) ..... 10-350262
Jul. 16, 1999 (JP) ..... 11-203922

(51) Int. Cl.[7] ..... F01C 1/02
(52) U.S. Cl. ..... 418/55.3; 418/57; 464/102
(58) Field of Search ..... 418/55.3, 57; 464/102

(56) References Cited

U.S. PATENT DOCUMENTS 5,542,829 * 8/1996 Inagaki et al. ..... 418/55.3
5,545,020 * 8/1996 Fukanuma et al. ..... 418/55.3
5,807,089 * 9/1998 Tsumagari et al. ..... 418/55.3

FOREIGN PATENT DOCUMENTS

656477-A * 6/1995 (EP) ..... 418/55.3
58-20401 2/1983 (JP) .
62-199983-A * 9/1987 (JP) ..... 418/55.3
63-25344 7/1988 (JP) .
05-018203-A * 1/1993 (JP) ..... 418/55.3
06-167284-A * 6/1994 (JP) ..... 418/55.3
6-68276 8/1994 (JP) .

* cited by examiner

*Primary Examiner*—Thomas Denion
*Assistant Examiner*—Theresa Trieu
(74) *Attorney, Agent, or Firm*—Oblon, Spivak, McClelland, Maier & Neustadt, P.C.

(57) ABSTRACT

A mechanism preventing rotation is mainly composed of plural swivel pins (31) projectingly provided on an end plate of a swiveling scroll (15), housing pins (32) which is the same number as the swivel pins (31) on a front end plate **(11*b*) provided onto the end plate, and a pin engaging member (33) having plural holes (34) in which these pins (31) and (32) respectively. These holes (34) are formed sufficiently larger diameter than the swivel pin (31) and the housing pin (32). According to this mechanism preventing rotation, while the swiveling scroll (15) performs a revolution swivel movement, these pins (31) and (32) and the inner surface of the pin engaging member (33)** controls radial maximum variation with sliding-contacting each other. Accordingly, fluid leak that occurs by an engaging position error of a stationary scroll and the swiveling scroll is effectively prevented and long service life and improvement of degree of freedom of designs are actualized.

16 Claims, 5 Drawing Sheets

SCROLL TYPE FLUID MACHINERY

BACKGROUND OF THE INVENTION

1. Field of the Invention

The present invention relates to a scroll type fluid machine to be used as a compressor or an expander, particularly, relates to a mechanism preventing rotation of a swiveling scroll.

This application is based on Japanese Patent Application Nos. Hei 10-350262 and Hei 11-203922 the contents of which are incorporated herein by reference.

2. Discussion of the Background

A mechanism preventing rotation of a swiveling scroll, for example, as shown in Japanese Unexamined Patent Application, First Publication, Nos. Sho 58-20401 (Kokai) and Sho 59-68585 (Kokai), having a swiveling scroll 1 comprising an end plate 1*a* and a swivel pin 1*b* provided projectingly from the end plate 1*a,* a housing 2 comprising a housing pin 2*a* provided projectingly from the housing 2, and a pin engaging member 3 through which the swivel pin 1*b* and the housing pin 2*a* are connected (see FIGS. 10 and 11), is known.

In the pin engaging member 3, two holes 4 are formed at a distance of e and the swivel pin 1*b* and the housing pin 2*a* are inserted into the holes 4 respectively in order to form the mechanism preventing rotation. In this mechanism preventing rotation, a crank 5 having an eccentricity distance ρ which is the same as the distance e is combined with a bearing 6 at the side of the swiveling scroll 1, then, a quadric link L as shown in FIG. 11 is formed, so that only rotation is prevented without preventing its revolution in the swiveling scroll 1.

The mechanism preventing rotation makes it possible to decrease a number of components and thus simplify the mechanism in comparison with a mechanism preventing rotation with a conventional Oldham ring or ball coupling, so that the mechanism preventing rotation can have advantages of miniaturization and lightening of the mechanism. Furthermore, the pin engaging member 3 and the like composing the mechanism preventing rotation can be easily prepared, therefore, cost can be reduced.

In the mechanism preventing rotation, since a relative distance between the swivel pin 1*b* and the housing pin 2*a* maintains the constant value (=e), a swivel diameter of the swiveling scroll 1 also keeps a constant value. Accordingly, if there is an engaging position error in the engagement of the swiveling scroll 1 and a stationary scroll (not shown), a gap occurs by the position error and liquid leaks through the gap, so that a volumetric efficiency may decrease or disperse.

On the other hand, a mechanism preventing rotation having a ring-shape pin engaging member 7 of which a swivel pin 1*b* and a housing pin 2*a* are inserted into an inner space portion 7*a,* as shown a principal portion thereof in FIGS. 12 and 13, is disclosed in Japanese Examined Patent Application, Second Publication, No. 6-68276 (Kokoku).

In this composition, variation of the relative distance between the swivel pin 1*b* and the housing pin 2*a* is accepted, so that the swivel diameter of the swiveling scroll 1 is variable and the engaging position error in the engagement between both scrolls can be offset.

However, the mechanism preventing rotation has the pin engaging member 7 which rolls according to the revolutional swivel movement of the swiveling scroll 1 and the swivel pin 1*b* and the housing pin 2*a* rolling-contact with the inside surface of the pin engaging member 7, and therefore, this mechanism preventing rotation has the disadvantage that each of these pins 1*b* and 2*a,* and the pin engaging member 7 has short fatigue life.

Moreover, by reason of design, when the pin diameters of the swivel pin 1*b* and the housing pin 2*a* are changed, a difference occurs among each relative rolling velocity of the pin 1*b,* 2*a,* and the pin engaging member 7 in the rolling contact, and accordingly, a relative slip occurs between one pin 1*b* (or 2*a*) and the pin engaging member 7, and thus partial wearing may occur. Therefore, there is a disadvantage that it is difficult to respond to design changes.

SUMMARY OF THE INVENTION

The present invention was achieved in view of the above circumstances, and the object of the present invention is to provide a swiveling scroll having variable swivel diameter in order to effectively prevent liquid from leaking.

Furthermore, another object of the present invention is to provide a mechanism for preventing rotation having long life and easily corresponding to a design change.

In order to solve the above-described problems, the present invention employs the following construction.

The present invention provides a scroll type fluid machine comprising a stationary scroll and a swiveling scroll each containing an involute wrap at a first end surface of an end plate in a standing state, wherein the stationary scroll and the swiveling scroll are mutually decentered, their phases are shifted, shifted scrolls are engaged with each other, and engaged scrolls are arranged in a housing, and the swiveling scroll performs a revolution swivel movement about the stationary scroll engaged in the housing; comprising a mechanism preventing rotation having: a swivel side pin projecting from a second end surface of the end plate of the swiveling scroll, a stationary side pin projecting from the housing to the second end surface side, a pin engaging member sliding these swivel side pin and stationary side pin at sliding contact portion with admitting radial variation and controlling maximum variation.

In the scroll type fluid machine, since the engaging position error between both scrolls is offset and the radial maximum displacement is limited by the stationary side pin and the swivel side pin slide-contacting the sliding contact portion of the pin engaging member, the fatigue life of each of the pin engaging member and both pins is longer than that of those members if they were rolling-contacted.

Moreover, by sliding-contacting both pins and the pin engaging member, a lubrication oil film can support a load as a sliding bearing, and even if outside diameters of both pins cannot have the same size, localized relative rolling cannot occur as in the case of rolling contact, therefore, it is partial wear cannot occur.

Furthermore, the scroll type fluid machine may have the pin engaging member comprising holes in which the swivel side pin and the stationary side pin is each engaged with free movement and inner surfaces of the holes are defined as the sliding contact portions.

In the above constructions, the swivel side pin and the stationary side pin is each inserted in the holes formed in the pin engaging member with free movement and relative interval variation between these pins in the holes is admitted, so that a swivel diameter can be variable as a matter of course, since these pins and the inner surfaces of the pin engaging members sliding-contact while the swiveling scroll performs the revolution swivel movement, as similar to the above, a load supported by lubrication oil film, longer fatigue life, and prevention of partial wear can be actualized.

The scroll type fluid machine may have the pin engaging member comprising a narrow hole in which the swivel side pin and the stationary side pin is each engaged at an interval with free movement and inner surfaces of the hole is defined as the sliding contact portion.

This narrow hole is obtained, for example, by connecting tangents with each hole enclosing the swivel side pin and the stationary side pin without crossing each other.

In these constructions, the swivel side pin performs circular motion with the swivel diameter that varies within the predetermined range to the predetermined swivel diameter around the stationary side pin. The inner surface of the pin engaging member engages a radial motion by sliding-contacting the outer surface of both pins. In the inner surface of the pin engaging member, the part to the outside of the centers of the pins engaged in the narrow hole with free movement effectively performs this engagement.

Therefore, the inner surface of the pin engaging member having one narrow hole which engages each other the swivel side pin and the stationary side pin at a interval with free movement, has the same engagement effect as the inner surface of the pin engaging member having holes which engage each of the swivel side pin and the stationary side pin with free movement.

The scroll type fluid machine may have the pin engaging member formed to be narrow along the line drawn through the swivel side pin and stationary side pin engaged with an interval with free movement.

In these constructions, the size and weight of the pin engaging member can be reduced.

The scroll type fluid machine may have the pin engaging member comprising a rough portion except for the sliding contact portion.

In this construction, the cost can be decreased further by leaving out finishing except for the sliding contact portion which is required to actualize preventing rotation of the swiveling scroll and variable swivel diameter, for example, by leaving out of finishing peripheral portion of the pin engaging member.

The scroll type fluid machine may comprise plural combinations wherein a pair of the swivel side pin and the stationary side pin is engaged with one pin engaging member.

In this construction, since a quadric link for preventing rotation changes according to the shift of the tooth flank contact point of both scrolls, the revolution swivel movement of the swiveling scroll can smoothly perform.

DESCRIPTION OF THE PREFERRED EMBODIMENTS

The working embodiments of the present invention will be explained with referring to figures as follows.

Figure 1:
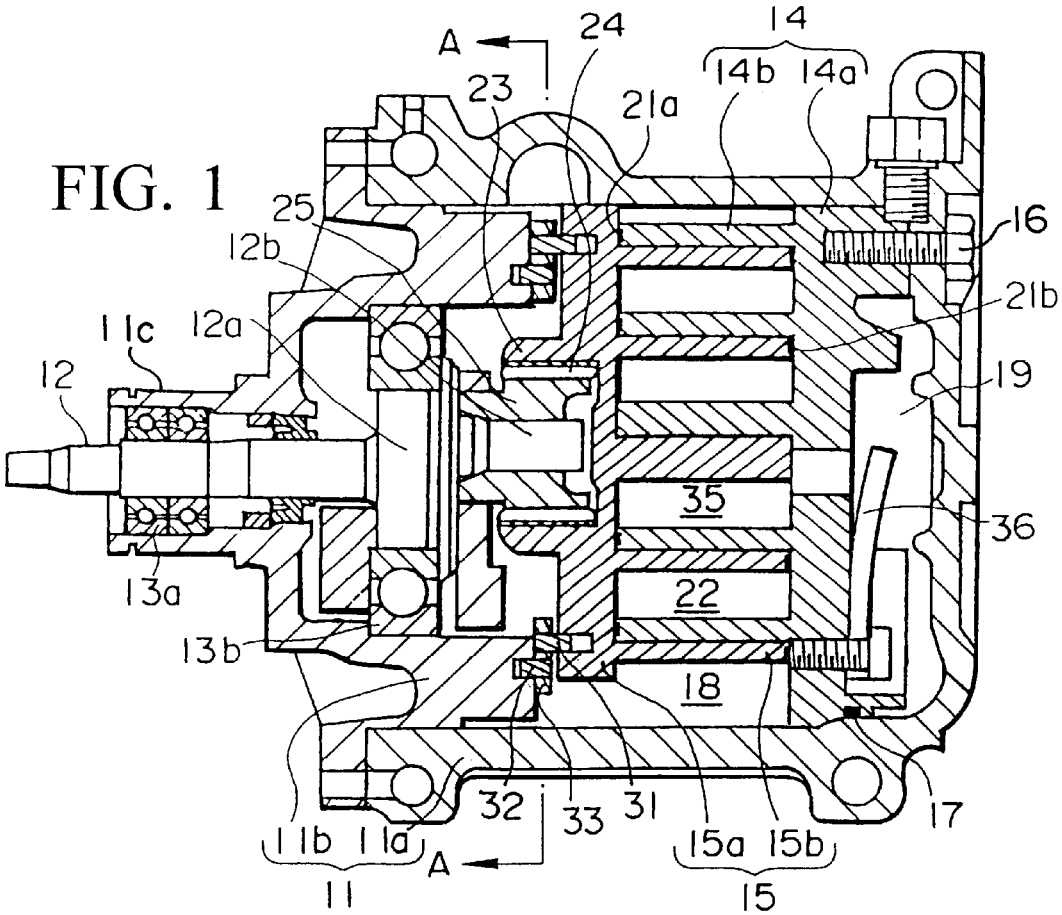
FIG. 1 is a longitudinal sectional view of a scroll type compressor showing the first embodiment of the present invention.
Figure 2:
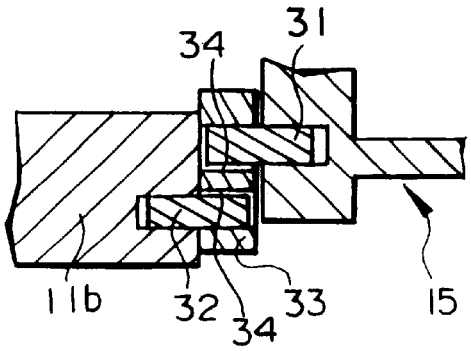
FIG. 2 is a principal enlarged view of the scroll type compressor according to FIG. 1.
Figure 3:
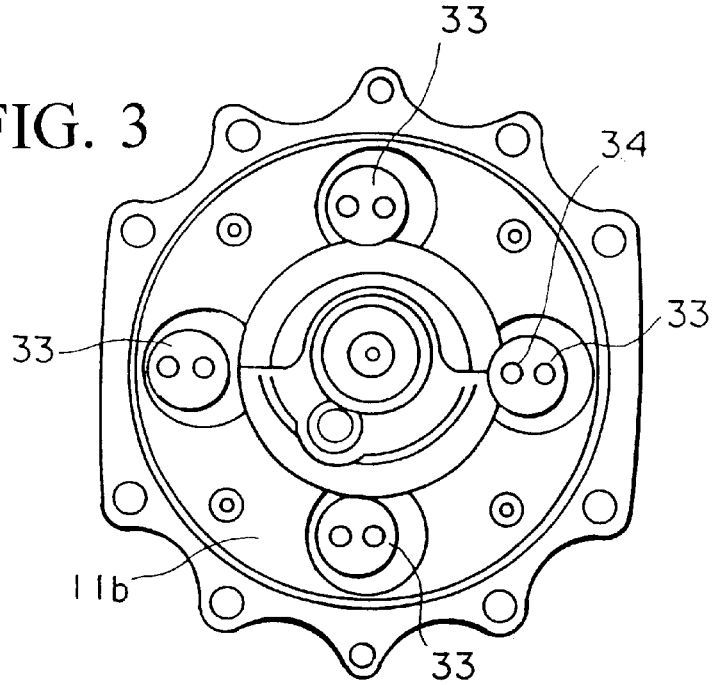
FIG. 3 is a cross sectional view taken on line A—A of the scroll type compressor according to FIG. 1.

FIG. 1 is a longitudinal cross sectional view showing whole construction of the scroll type compressor according to the first embodiment of the present invention. In FIG. 1, there is a housing 11 comprising a cup type main body 11*a,* and a front end plate 11*b* provided on the side of an opening end of the cup type main body 11*a.*

A rotation axis 12 with a crank 12*a* at the end of the axis passes through the cylindrical portion 11*c* of the front end plate 11*b* and is supported by the cylindrical portion 11*c* providing bearings.

In the housing 11, a stationary scroll 14 and a swiveling scroll 15 are provided. The stationary scroll 14 comprises an end plate 14*a* and an involute wrap 14*b* and the end plate 14*a* is engaged to the cup type main body 11*a* with a bolt 16. An O-ring 17 is embedded in the outer surface side of the end plate 14*a* and tightly contacted to the inside surface of the cup type main body 11*a*. Accordingly, at the left side of the end plate 14*a* in FIG. 1, an inlet chamber 18 is formed and at the right side of the end plate 14*a,* a discharge cavity 19 is formed.

The swiveling scroll 15 comprises, similar to the stationary scroll 14, an end plate 15*a* and an involute wrap 14*b,*which is provided at an end face of the end plate. The involute wrap 15*b* has the same shape as the involute wrap 14*b* of the stationary scroll 14. Then, the swiveling scroll 15 and the stationary scroll 14 are engaged each other eccentrically to the revolution scroll diameter and a phase shift of 180°.

In end surfaces of inner wraps of the involute wraps 14*b* and 15*b*, chip seals 21*a* and 21*b* are embedded, respectively. These chip seals 21*a* and 21*b* tightly contact to each one end surface of the end plates 14*a* and 15*a,* at the same time, contact to plural parts of each side of the involute wraps 14*b* and 15*b*. Plural sealed spaces 22, which are in point symmetry with regard to these centers of the involute wraps 14*b* and 15*b,*are formed between the involute wraps 14*b* and 15*b*.

A boss 23 is projectingly provided at a center of another end surface of the end plate 15*a* for a swiveling scroll and an eccentric pin 12*b* of the crank 12*a* is rotatably arranged in the boss 23, wherein a swivel scroll bearing 24 and a drive bush 25 are provided therebetween.

Furthermore, a mechanism preventing rotation of the swiveling scroll 15 is provided between outer edge of another end surface of the end plate 15*a* for a swiveling scroll and the front end plate 11*b*.

The mechanism preventing rotation will be explained as referring to FIGS. 1 to 4 as follows.

Plural (four pins in one example of the present invention) swivel pins (pins on the swiveling side) 31 are projectingly provided on another end surface side of the end plate 15*a* for a swiveling scroll at circumferential regular interval.

Furthermore, plural housing pins 32, which is the same number as swivel pins 31, are projectingly provided on one end surface of the front end plate 11*b*,which faces the swiveling scroll 15, at circumferential regular interval.

Circular pin engaging members 33 are provided between the another end surface of the end plate 15*a* and one end surface of the front end plate 11*b*. A pair of holes 34 into which the swivel pin 31 and the housing pin 32 are respectively inserted with free movement on these pin engaging members 33. That is, these holes 34 are sufficiently larger than the swivel pin 31 or the housing pin 32.

Moreover, an interval e between centers of these holes 34 is arranged so as to be the same interval as an eccentric interval of the electric pin 126 and the eccentric interval is defined as a swivel diameter of the swiveling scroll 15.

In the embodiment, perforated holes as holes 34 are described, however, blind holes which are open on either end surface of the pin engaging member 33 may be used.

As rotating the rotation axis 12, the swiveling scroll 15 performs revolution swivel movement on a circular orbit having the eccentric interval of the crank 12*a* as a diameter through the swivel drive mechanism composed of the crank 12*a,* the boss 23, the swivel scroll bearing 24, and the like, while its rotation is prevented by the mechanism preventing rotation. According to the above movement, a line contact portion between the involute wraps 14*b* and 15*b* gradually moves in the direction of the center of the convolutions, accordingly, the sealed spaces 22 gradually moves in the direction of the center of the convolutions as reducing their volume.

The fluid flowing into a suction chamber 18 through a suction inlet flows into the sealed spaces 22 from the outer end openings between the involute wraps 14*b* and 15*b,* thereafter, the fluid arrives at the central portion 35, being compressed.

The compressed fluid flows into a discharge cavity 19 by pushing and opening a delivery valve 36 and flows outside through an outlet (not shown).

In the above fluid compression operation, if there is a tooth flank error in engaging with the stationary scroll 14 and the swiveling scroll 15, fluid leaks from the sealed spaces 22 to outside, so that volumetric efficiency is reduced and dispersion occurs.

According to the above mechanism preventing rotation, there is free movement between the swivel pin 31 and the housing pin 32, and the holes 34 corresponding to the pin engaging member 33, so that variation of the relative interval between these pin 31 and 32 can be admitted. That is, the swivel diameter of the swiveling scroll 15 becomes variable and even if the error occurs in engaging of the scrolls 14 and 15, error can be offset in the mechanism, therefore, the sealing characteristic increases.

Therefore, according to the mechanism preventing rotation of the embodiment, a scroll type compressor having high efficiency, which effectively prevents reduction and dispersion of the volume efficiency by fluid leak, can be obtained.

Of course, rotation of the swiveling scroll 15 is reliably prevented when the relative interval between these pins 31 and 32 varies because a portion of nodal points of the quadric link is simply transferred from the contact point of the both pins 31 and 32, and the holes 34 to the tooth flank contact point of both scrolls 14 and 15.

Furthermore, in the present embodiment, since four combinations that a pair of the swivel pin 31 and the housing pin 32 is engaged by one pin engaging member 33 are arranged, the quadric link for preventing rotation changes as tooth flank contact point of both scrolls 14 and 15 transferred. Accordingly, the mechanism preventing rotation having smooth revolution swivel movement of the swiveling scroll 15 is composed.

Moreover, while the swiveling scroll 15 is performing the revolution swivel movement, radial variation of the swivel pin 31 and the housing pin 32 is engaged with the inside surface of the pin engaging member 33 (the sliding contact portion) having holes 34 with sliding-contacting the inside surface of the pin engaging member 33, so that a lubrication oil film can support a load as a sliding bearing. Therefore, the swivel pin 31, the housing pin 32, and the pin engaging member 33 can have a long service life.

Even if, by reason of design, the diameters of the swivel pin 31 and the housing pin 32 have to be changed, the lubrication oil film prevents partial wear from occurring, so that a degree of freedom of design can increase.

Next, the second embodiment will be described with reference to FIG. 5.

A scroll type compressor according to the present embodiment is characterized in that a racetrack shaped hole (an oval with two parallel straight portions) is formed in a pin engaging member so that a swivel pin and a housing pin can be engaged into the hole at a suitable interval with free movement. Other components are the same as those of the first embodiment.

The following are explanations of constructions and effects of the pin engaging member according to the present embodiment.

Figure 4:
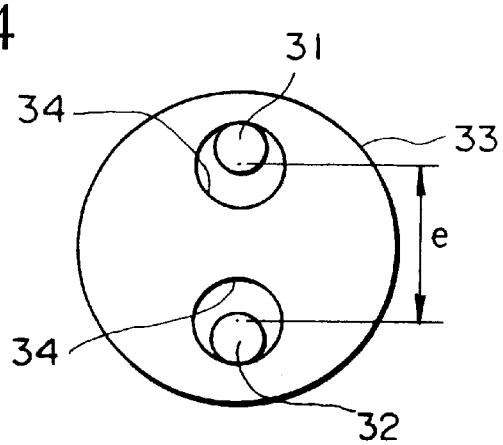
FIG. 4 is a principal enlarged view of the cross sectional view taken on line A—A according to FIG. 3.
Figure 5:
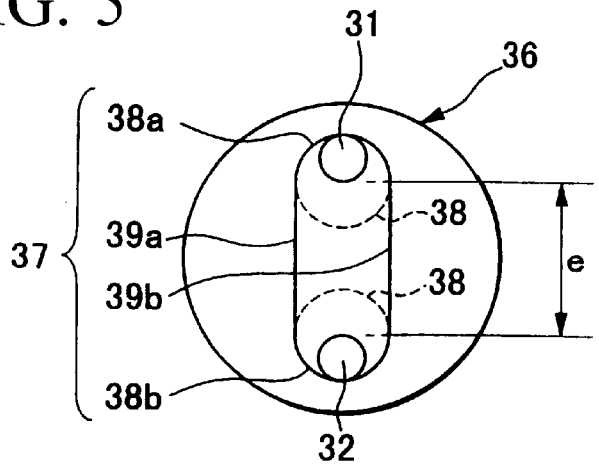
FIG. 5 is a plan view of a pin engaging member showing the second embodiment of the present invention.

In FIG. 5, the pin engaging member 36 comprises the racetrack shaped hole 37 which is shaped by joining tangents 39*a* and 39*b* without crossing each other to a pair of holes 38 which is the same shape as the holes 34 in FIG. 4 (the first embodiment), that is to say, holes 38, 38 engaging each of the swivel pin 31 and the housing pin 32 with free movement, and enclosing the holes 38 with outer semicircular portions 38*a* and 38*b* placing outer than the center of these holes 38 and the above two tangents 39*a* and 39*b*.

According to the above construction, the swivel pin 31 performs circular motion around the housing pin 32 with a swivel diameter that varies within predetermined range to the predetermined swivel diameter. Then, the inner surface (the sliding contact portion) of the pin engaging member 36 having the race track shape hole 37 limits the radial movement by sliding-contacting with the outer surfaces of the swivel pin 31 and the housing pin 32. For this limitation, only the outer semicircular portions 38*a* and 38*b* arranged in outer radial than the center of each pins 31 and 32, effectively limits the radial movement. Since the inner surface of the pin engaging member 36 limits the radial movement similar to the inner surface of the pin engaging member 33 according to the first embodiment, in the scroll type compressor of the present embodiment, aforementioned high efficiency, long life, and improvement of the degree of freedom for designs can be obtained.

Next, the third embodiment of the present invention will be explained with reference to FIGS. 6 to 8.

A scroll type compressor according to the present embodiment is characterized in the pin engaging member and others are the same as those of the first embodiment. Thus, only the pin engaging member will be explained as follows.

Figure 6:
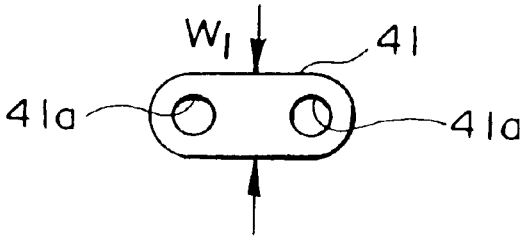
FIG. 6 is a plan view of a pin engaging member showing the third embodiment of the present invention.
Figure 7:
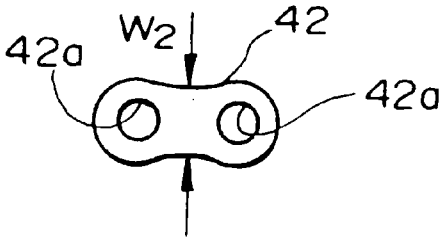
FIG. 7 is a modified embodiment of the pin engaging member according to FIG. 5.
Figure 8:
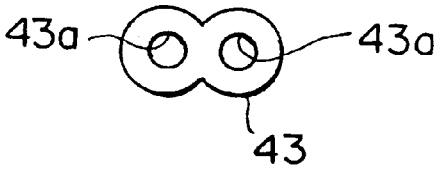
FIG. 8 is another modified embodiment of the pin engaging member according to FIG. 5.

FIG. 6 shows a pin engaging member according to the present embodiment and FIGS. 7 and 8 are plan views showing its modified examples. These pin engaging members 41, 42, and 43 are formed to be narrow along the line drawn through the holes 41*a,* 42*a,* and 43*a,* respectively.

In the pin engaging member 41 shown in FIG. 6, the width W1, which is perpendicular to the line drawn through the holes 41*a,* has uniform width between one hole 41*a* and another hole 41*a.*

In the pin engaging member 42 shown in FIG. 7, the width W2 in the direction perpendicular to the length of the pin engaging member 42 of the constricted portion between holes 42*a* is defined so as to be narrower than the width in the direction perpendicular to the length of the pin engaging member 42 of along the lines tangential to the outer end of the holes 42*a.* The pin engaging member 43 shown in FIG. 8 is formed as a figure "8".

Therefore, these pin engaging members 41, 42, and 43 can be formed smaller size than pin engaging members 33, 36 of the first and second embodiments, so that those weights can be reduced.

Next, the fourth embodiment of the present invention will be explained with reference to FIG. 9.

A scroll type compressor according to the present embodiment is characterized in the pin engaging member and others are the same as those of the first embodiment. Thus, only the pin engaging member will be explained as follows.

Figure 9:
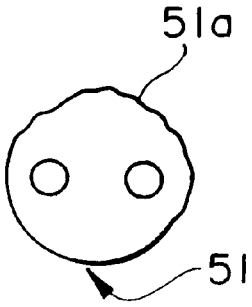
FIG. 9 is a plan view of a pin engaging member showing the fourth embodiment of the present invention.
Figure 10:
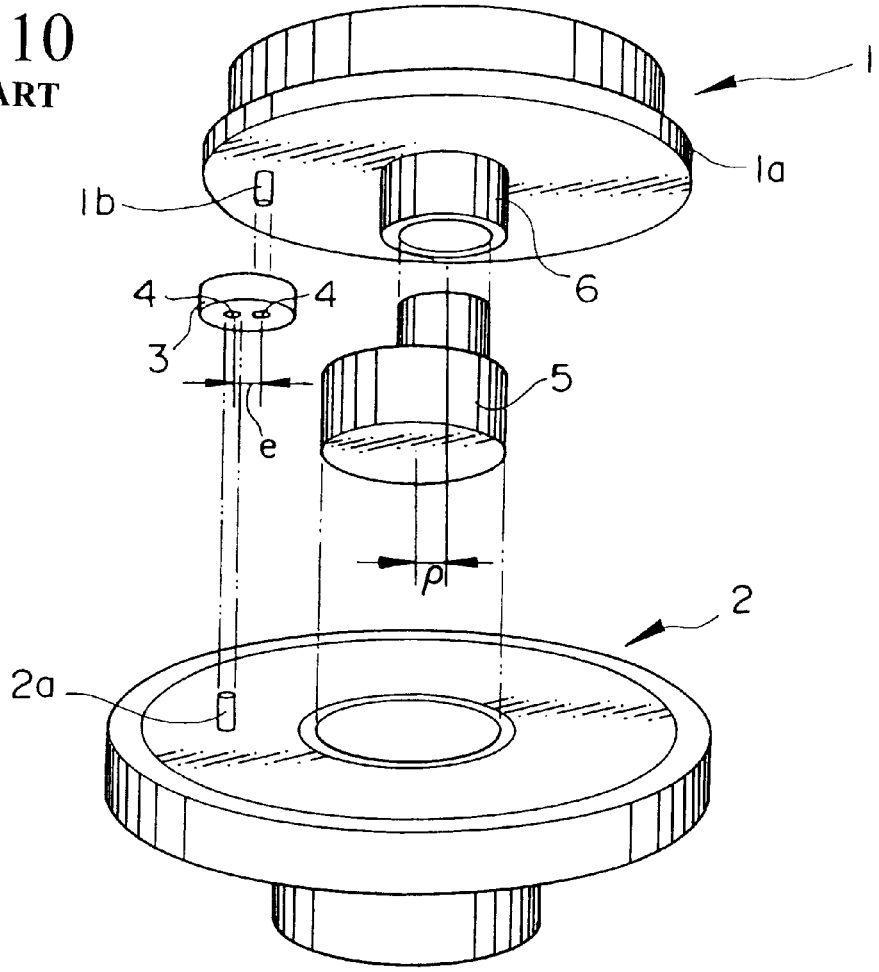
FIG. 10 PRIOR ART
FIG. 10 is a perspective view of a conventional embodiment of a mechanism preventing rotation of the swiveling scroll.
Figure 11:
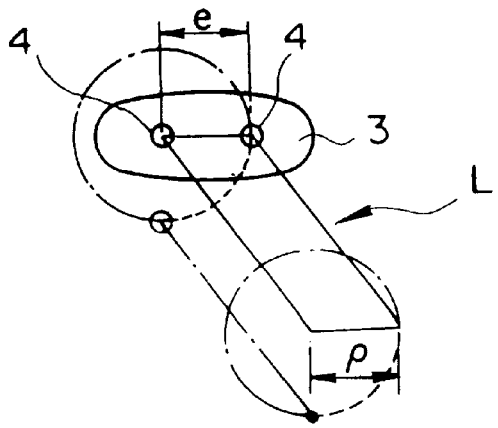
FIG. 11 PRIOR ART
FIG. 11 is a motion view showing an action of the mechanism preventing rotation according to FIG. 10.
Figure 12:
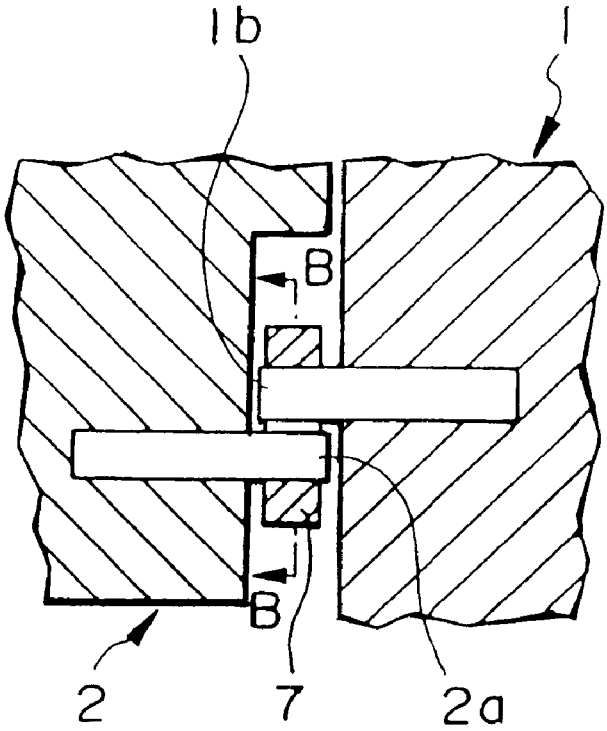
FIG. 12 PRIOR ART
FIG. 12 is a principal longitudinal cross sectional view of another conventional embodiment of a mechanism preventing rotation.
Figure 13:
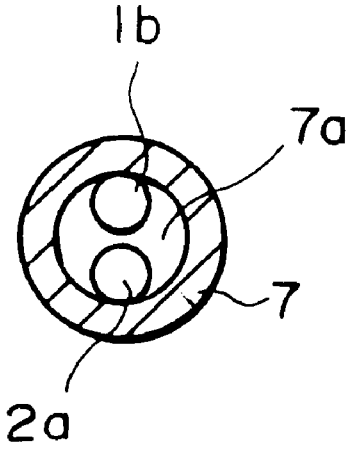
FIG. 13 PRIOR ART
FIG. 13 is a cross sectional view taken on line B—B of the mechanism preventing rotation according to FIG. 12.

FIG. 9 is a plan view showing the pin engaging member 51 according to the present embodiment and the pin engaging member 51 is formed of the same circular shape as the first embodiment, however its peripheral portion 51*a* may be rough because the peripheral portion 51*a* of the pin engaging member 51 does not always need to be highly finished when preventing rotation of the swiveling scroll 15 and variable of the swivel diameter are actualized.

Therefore, according to the present embodiment, since the finishing step for the peripheral portion 51*a* of the pin engaging member 51 is left out, the cost can be reduced.

The above every embodiments relates to the scroll type compressor, however, the present invention can be applied to scroll type expander as a matter of course.

INDUSTRIAL APPLICABILITY

As explained above, the following effects are obtained according to the present invention.

(a) The scroll type fluid machine of the present invention has a mechanism preventing rotation which controls maximum variation while the swivel side pin and the stationary side pin sliding-contact the sliding contact portion of the pin engaging member and variation in the direction of the diameter is admitted, so that even if tooth flank error occurs in engaging of both scrolls, fluid leak is effectively prevented and high efficiency can be actualized and also parts composing the mechanism preventing rotation can be actualized in a long service life and an improvement in the degree of freedom of design.

(b) The above scroll type fluid machine has the mechanism preventing rotation wherein the swivel diameter of the swiveling scroll can be variable while the swivel side pin and the stationary side pin are inserted into holes formed in the pin engaging member with free movement, these pins and the inner surface of pin engaging member slid-contact each other when the swiveling scroll is in revolution swivel movement. Therefore, as same as the above (a), high efficiency, long service life, and an improvement in the degree of freedom of design can be actualized.

(c) The above scroll type fluid machine has the mechanism preventing rotation wherein the swivel side pin and the stationary side pin are inserted into a racetrack shaped hole formed in the pin engaging member with free movement and when the swiveling scroll is in revolution swivel movement, in the inner surface of the pin engaging member, parts of the outside of the centers of the swivel side pin and the stationary side pin engaged in the racetrack shape hole with free movement provide effective engagement. Therefore, as same as the above (b), high efficiency, long service life, and an improvement in the degree of freedom of design can be actualized.

(d) According to the above scroll type fluid machine, the pin engaging member can be formed having smaller size, so that the weight of the machine can be decreased.

(e) According to the above scroll type fluid machine, since finishing of the peripheral portion of the pin engaging member is omitted, cost can be reduced.

(f) According to the above scroll type fluid machine, since quadric link for preventing rotation changes when tooth flank contact point of both scrolls transfer, the revolution swivel movement of the swiveling scroll can perform smoothly.

What is claimed is:

1. A scroll type fluid machine comprising a stationary scroll and a swivelling scroll each containing an involute wrap at a first end surface of an end plate in a standing state, wherein the stationary scroll and the swiveling scroll are mutually decentered, their phases are shifted, shifted scrolls are engaged with each other, and engaged scrolls are arranged in a housing, and the swiveling scroll performs a revolution swivel movement about the stationary scroll engaged in the housing; comprising a mechanism preventing rotation having:

a swivel side pin projecting from a second end surface of the end plate of the swiveling scroll, a stationary side pin projecting from the housing to the second end surface side, and a pin engaging member having means for receiving the swivel side pin and the stationary side pin including a sliding contact portion that allows sliding radial variation between the swivel side pin and the stationary side pin and controls maximum variation.

2. A scroll type fluid machine according to claim 1, wherein the pin engaging member comprises holes in which each of the swivel side pin and the stationary side pin are engaged with free movement and inner surfaces of the holes are defined as the sliding contact portions.

3. A scroll type fluid machine according to claim 2, comprising plural combination that a pair of the swivel side pin and the stationary side pin is engaged with one pin engaging member.

4. A scroll type fluid machine according to claim 1, wherein the pin engaging member comprises a narrow hole in which each of the swivel side pin and the stationary side pin is engaged at an interval with free movement and the inner surface of the hole is defined as the sliding contact portion.

5. A scroll type fluid machine according to claim 4, comprising plural combination that a pair of the swivel side pin and the stationary side pin is engaged with one pin engaging member.

6. A scroll type fluid machine according to claim 1, comprising plural combination that a pair of the swivel side pin and the stationary side pin is engaged with one pin engaging member.

7. A scroll type fluid machine comprising a stationary scroll and a swivelling scroll each containing an involute wrap at a first end surface of an end plate in a standing state, wherein the stationary scroll and the swiveling scroll are mutually decentered, their phases are shifted, shifted scrolls are engaged with each other, and engaged scrolls are arranged in a housing, and the swiveling scroll performs a revolution swivel movement about the stationary scroll engaged in the housing; comprising a mechanism preventing rotation having:

a swivel side pin projecting from a second end surface of the end plate of the swiveling scroll, a stationary side pin projecting from the housing to the second end surface side, a pin engaging member sliding these swivel side pin and stationary side pin at sliding contact portion with admitting radial variation and controlling maximum variation, wherein the pin engaging member comprises holes in which each of the swivel side pin and the stationary side pin are engaged with free movement and inner surfaces of the holes are defined as the sliding contact portions, and wherein the pin engaging member is formed to be narrow along the line drawn through the swivel side pin and stationary side pin engaged with an interval with free movement.

8. A scroll type fluid machine according to claim 3, wherein the pin engaging member comprises a rough portion except the sliding contact potion.

9. A scroll type fluid machine according to claim 3, comprising plural combination that a pair of the swivel side pin and the stationary side pin is engaged with one pin engaging member.

10. A scroll type fluid machine comprising a stationary scroll and a swivelling scroll each containing an involute wrap at a first end surface of an end plate in a standing state, wherein the stationary scroll and the swiveling scroll are mutually decentered, their phases are shifted, shifted scrolls are engaged with each other, and engaged scrolls are arranged in a housing, and the swiveling scroll performs a revolution swivel movement about the stationary scroll engaged in the housing; comprising a mechanism preventing rotation having:

a swivel side pin projecting from a second end surface of the end plate of the swiveling scroll, a stationary side pin projecting from the housing to the second end surface side, a pin engaging member sliding these swivel side pin and stationary side pin at sliding contact portion with admitting radial variation and controlling maximum variation, wherein the pin engaging member comprises a rough portion except the sliding contact portion.

11. A scroll type fluid machine according to claim 10, comprising plural combination that a pair of the swivel side pin and the stationary side pin is engaged with one pin engaging member.

12. A scroll type fluid machine comprising a stationary scroll and a swivelling scroll each containing an involute wrap at a first end surface of an end plate in a standing state, wherein the stationary scroll and the swiveling scroll are mutually decentered, their phases are shifted, shifted scrolls are engaged with each other, and engaged scrolls are arranged in a housing, and the swiveling scroll performs a revolution swivel movement about the stationary scroll engaged in the housing; comprising a mechanism preventing rotation having:

a swivel side pin projecting from a second end surface of the end plate of the swiveling scroll, a stationary side pin projecting from the housing to the second end surface side, a pin engaging member sliding these swivel side pin and stationary side pin at sliding contact portion with admitting radial variation and controlling maximum variation, wherein the pin engaging member comprises a narrow hole in which each of the swivel side pin and the stationary side pin is engaged at an interval with free movement and the inner surface of the hole is defined as the sliding contact portion, and wherein the pin engaging member is formed to be narrow along the line drawn through the swivel side pin and stationary side pin engaged with an interval with free movement.

13. A scroll type fluid machine comprising a stationary scroll and a swivelling scroll each containing an involute wrap at a first end surface of an end plate in a standing state, wherein the stationary scroll and the swiveling scroll are mutually decentered, their phases are shifted, shifted scrolls are engaged with each other, and engaged scrolls are arranged in a housing, and the swiveling scroll performs a revolution swivel movement about the stationary scroll engaged in the housing; comprising a mechanism preventing rotation having:

a swivel side pin projecting from a second end surface of the end plate of the swiveling scroll, a stationary side pin projecting from the housing to the second end surface side, a pin engaging member sliding these swivel side pin and stationary side pin at sliding contact portion with admitting radial variation and controlling maximum variation, wherein the pin engaging member comprises holes in which each of the swivel side pin and the stationary side pin are engaged with free movement and inner surfaces of the holes are defined as the sliding contact portions, and wherein the pin engaging member comprises a rough portion except the sliding contact potion.

14. A scroll type fluid machine comprising a stationary scroll and a swivelling scroll each containing an involute wrap at a first end surface of an end plate in a standing state, wherein the stationary scroll and the swiveling scroll are mutually decentered, their phases are shifted, shifted scrolls are engaged with each other, and engaged scrolls are arranged in a housing, and the swiveling scroll performs a revolution swivel movement about the stationary scroll engaged in the housing; comprising a mechanism preventing rotation having:

a swivel side pin projecting from a second end surface of the end plate of the swiveling scroll, a stationary side pin projecting from the housing to the second end surface side, a pin engaging member sliding these swivel side pin and stationary side pin at sliding contact portion with admitting radial variation and controlling maximum variation, wherein the pin engaging member comprises a narrow hole in which each of the swivel side pin and the stationary side pin is engaged at an interval with free movement and the inner surface of the hole is defined as the sliding contact portion, and wherein the pin engaging member comprises a rough portion except the sliding contact potion.

15. A scroll fluid machine comprising:

a housing;

a stationary scroll provided within and engaged to said housing, said stationary scroll having an involute wrap;

a swiveling scroll provided within said housing, said swiveling scroll having an involute wrap affixed on an end plate, said involute wrap of said stationary scroll and said involute wrap of said swiveling scroll being engaged having shifted phases and being mutually decentered such that said swiveling scroll is configured to perform a revolution swivel movement about said stationary scroll;

a first pin projecting from said end plate of the swiveling scroll;

a second pin projecting from said housing; and a pin engaging member having a hole configured to receive said first pin and said second pin, said hole having straight portions generally extending between said first pin and said second pin such that said hole is configured to allow restricted variation in a distance between said first pin and said second pin.

16. A scroll fluid machine comprising:

a housing;

a stationary scroll provided within and engaged to said housing, said stationary scroll having an involute wrap;

a swiveling scroll provided within said housing, said swiveling scroll having an involute wrap affixed on an end plate, said involute wrap of said stationary scroll and said involute wrap of said swiveling scroll being engaged having shifted phases and being mutually decentered such that said swiveling scroll is configured to perform a revolution swivel movement about said stationary scroll;

a first pin projecting from said end plate of the swiveling scroll;

a second pin projecting from said housing; and a pin engaging member having a first hole configured to receive said first pin and a second hole configured to receive said second pin, at least one of said first hole and said second hole having an enlarged contacting portion configured to slidably receive a corresponding one of said first pin and said second pin to allow restricted variation in a distance between said first pin and said second pin.

* * * * *